United States Patent [19]

Kalpins

[11] Patent Number: 4,674,918

[45] Date of Patent: Jun. 23, 1987

[54] ANCHORING FLOATING STRUCTURAL BODY IN DEEP WATER

[76] Inventor: Alexandrs K. Kalpins, 144 S. Halifax Ave., Apt. 16, Daytona Beach, Fla. 32018

[21] Appl. No.: 773,362

[22] Filed: Sep. 6, 1985

[51] Int. Cl.[4] ..... B63B 35/44

[52] U.S. Cl. ..... 405/224; 114/264; 405/202

[58] Field of Search ..... 405/195, 202, 224; 114/264, 265

[56] References Cited

U.S. PATENT DOCUMENTS

| | | | |
|---|---|---|---|
| 3,690,108 | 9/1972 | Tam | 405/202 |
| 3,961,490 | 6/1976 | Corgnet | 405/224 X |
| 3,986,367 | 10/1976 | Kalpins | 405/225 |
| 3,986,471 | 10/1976 | Haselton | 114/265 |

FOREIGN PATENT DOCUMENTS

| | | | |
|---|---|---|---|
| 1337601 | 11/1973 | United Kingdom | 114/265 |

*Primary Examiner*—David H. Corbin

[57] ABSTRACT

Disclosed is a deep water anchoring system including a structural body floating at the surface of a body of water and with an intermediate floating member directly under and spaced from the floating structural body, the intermediate floating member being submerged below the surface of the water a distance sufficient to be unaffected directly by surface winds and waves. A gravity anchor along the bed of the body of water is coupled to the intermediate floating member via multiple cables which perferably extend angularly outwardly from the intermediate floating member. The anchoring system is provided with at least three separate and rigid rods, each of which are rotatably coupled at one end to the intermediate floating member and rotatably coupled at the other end to the floating structural body.

8 Claims, 5 Drawing Figures

ANCHORING FLOATING STRUCTURAL BODY IN DEEP WATER

FIELD OF THE INVENTION

This invention relates to anchoring the floating structural bodies such as an oil drilling platform, floating ports and the like in deep water so that the floating structural body is kept in elastically safe working conditions and minimizing swinging.

BACKGROUND OF THE INVENTION

In U.S. Pat. No. 3,986,367 filed Oct. 1, 1975 owned in common with this invention. The floating structural body has RIGID HANGING ELEMET hanging by flexible cables. The rigid hanging element is anchored to the ground foundation by slope cables which hold the rigid hanging element and floating structural body in position, but do not transfer the horizontal ground motion (earthquake) to the floating structural body. The floating structural body under wave, windstorm, hurricanes, tornadoes pressure can move horizontally, twist and swing independently from the rigid hanging element.

The present invention is concerned with minimizing the swinging of the floating structural body. The INTERMEDIATE FLOATING ELEMENT is not hanging but supporting the floating structural body. The rods join the floating structural body and intermediate floating element and have ball joints at the top and bottom. The intermediate element is held by sloped cables anchored in sealed gravity foundation in horizontal and vertical position. The floating structural body under wave, windstorm, hurricanes, tornadoes pressure can move elastically horizontally and twist independently from the intermediate floating element, but cannot swing. The floating structural body can move only parallel to the intermediate floating element.

WAVE ACTION TO THE FLOATING STRUCTURAL BODY

Water waves may be caused by earthquakes, bom explosions in water, tides or winds. It is the latter which produce the waves which enginiers are most interested.

WAVE GENERATION FROM WIND

Waves are generated by the transfer of energy from air moving over the water surface. The transfer is effected in two ways:

FIRST: The water surface reacts to small differces in pressure of the moving air, which creates the first variation in the water level. These are increased differences in pressure exerted by the moving wind on the back and on the front of the wave.

SECOND: Tangential stress ocours between the two fluids, air and water, which are in contact and moving at different speeds relative to each other. Since both normal pressure and tangential stress are functions of the wind velocity it follows that wave characteristics also are functions of wind velocity.

WAVE FORM

Waves manifest themselves by curved undulation of the surface of the water occurring at periodic intervals, it is the wave form and not the water which moves over surface as a result of the orbital motion of surface water particles, which oscillate back and forth, but do not advance. The floating object in deep water will rise and fall with the undulation of the waves, but will not move horizontally unless it is moved by wind, current or other forces, except for a small back and forth motion caused by the orbital motion of the water particles.

The size of a wave for a particular location will depend upon the velocity of the wind, the duration of the wind, the direction of the wind, the greatest distance over which the wind can act, and depth of the water.

WAVE ACTION TO THE FLOATING STRUCTURAL BODY

The wave pressure against the floating structural body consists of: (a) hydrostatic pressure which varies as the wave rises and falls. The waves act on both sides of the floating structural body, maximum net horizontal force will occur when the crest acts against one side when the trough acts against the other. (b) The dynamic pressure acts near the region where the wave crest hits the floating structural body. The floating structural body under the wave hydrostatic and dynamic loads moves horizontally, vertically, swings and posibly twists.

WIND ACTION TO THE FLOATING STRUCTURAL BODY

The circulation of masses air mor less paralel to the earth's surface is known as wind. The side of a structure facing the direction from which the wind comes is the windward side and the opposite side is the leeward side.

The wind loads to the floating structural body are assumed to act from the water level up. The total wind pressure on a floating structural body varies with shape. Winds, impinging on the varied surfaces offered by the floating structural body, could develop large forces on the windward side, but considerably less than those produced by a tornado.

The tornado is defined as a moving spiral of air, spinning in a vertical cylinder with wind velocities at the cylinder wall of up to 300 m.p.h. and reduced air pressure inside the cylinder. The action of a tornado that moves directly into a floating structural body produces very large lateral and rotational forces, followed by a powerful lift, as the center of the tornado moves forward accross the floating structural body.

The floating structural body under dynamic and static wind load moves horizontally, swings and possibly twists.

BRIEF SUMMARY OF THE INVENTION

The present invention contemplates a new anchoring system in deep water in wich the floating structural body is not directly supported or anchored in seabed. New is the introduction of an INTERMEDIATE FLOATING ELEMENT between the floating structural body and seabed close and directly under the floating structural body. The new anchoring system generally consists of two parts.

The FIRST is an intermediate floating element, slope cables under tension force and gravity foundation on seabed. There is no direct wave, wind and tornado action to the intermediate floating element. The weight of the intermediate floating element is less than the weight of the displaced water, therefore there is hydrostatic upward force-uplift force. The slope cables, under tension force, anchored by conventional methods, on sealed concrete gravity foundation hold the intermediate floating element in horizontal and vertical position.

The SECOND part is platform, hull and rods. The hull is for two reasons: (a) to rise the uplift force in rods. The weight of the hull is less than the displaced water. (b) the instalations facilities. After the hull is instaled in its position it will be made permanent with platform by bolts, welding or otherwise and both called FLOATING STRUCTURAL BODY.

The vertical and equally long peripherial placed rods join the floating structural body and intermediate floating element and have conventional ball bearing joints at the top and bottom. The floating structural body under wave, windstrom, hurricanes, tornadoes pressure can move horizontally in all directions independently from the intermediate floating element holding by slope cables in horizontal and vertical position, but can not swing. The floating structural body can move only paralel to the intermediate floating element.

The action is similar to the elastic SPRING action. Sloping the rods 15 at the top of the rods 16 increases the HORIZONTAL COUNTERFORCE 23 to the windstrom, tornado, wave HORIZONTAL COMPONENT 22.

The presentation of the force action is only for 16, but the same forces are in point 17, only in reverse direction.

DETAILED DESCRIPTION OF PREFERED EMBODIMENT

Figure 1:
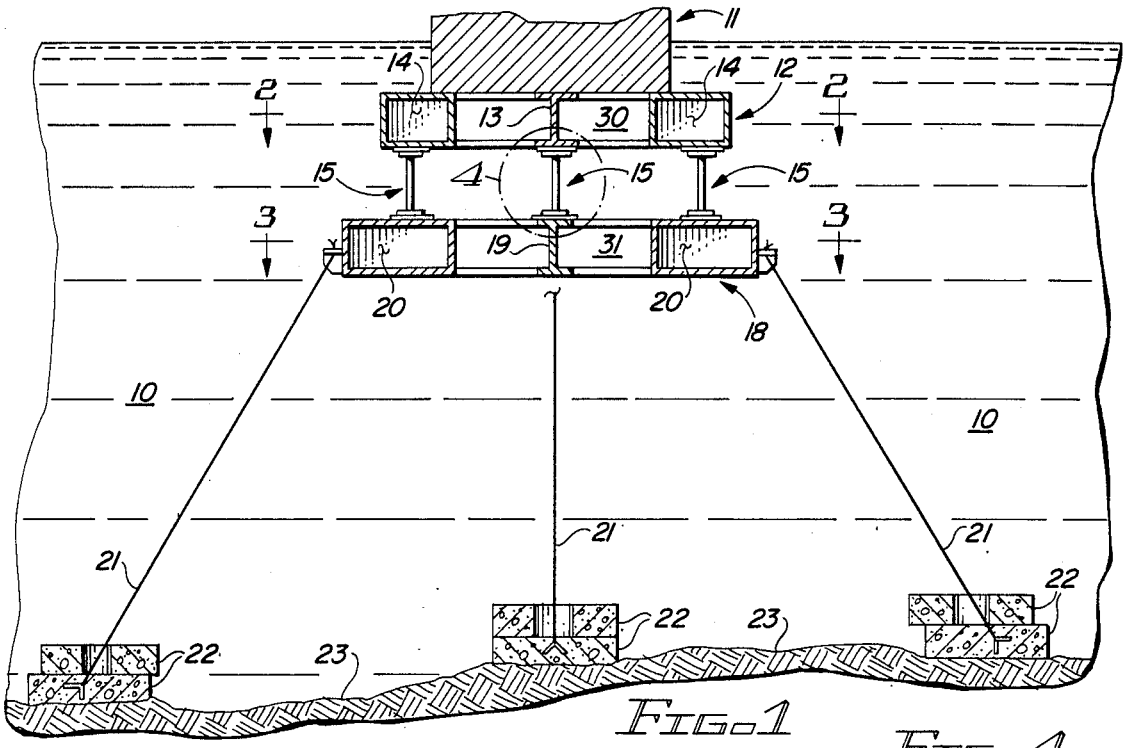
FIG. 1 is an elevational view, taken along plane 1—1 FIGS. 2 and 3, in section, showing a floating structural body, positioned in deep water anchored in accordance with the present invention.
Figure 2:
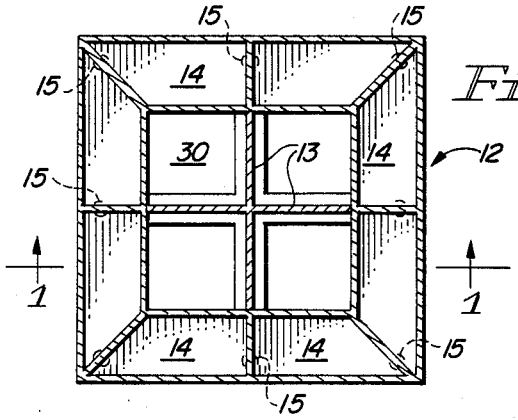
FIG. 2 is a horizontal cross-section view taken along place 2—2 in FIG. 1.
Figure 4:
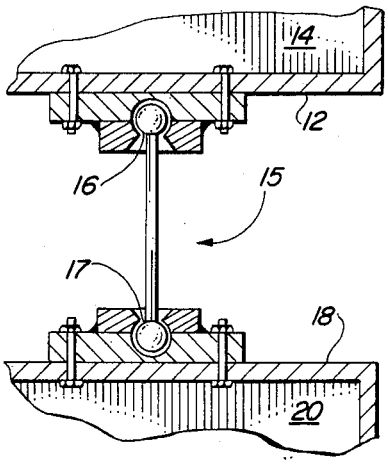
FIG. 4 is enlarged detailed sectional view of the rods, taken along plane 4—4 in FIG. 1.
Figure 3:
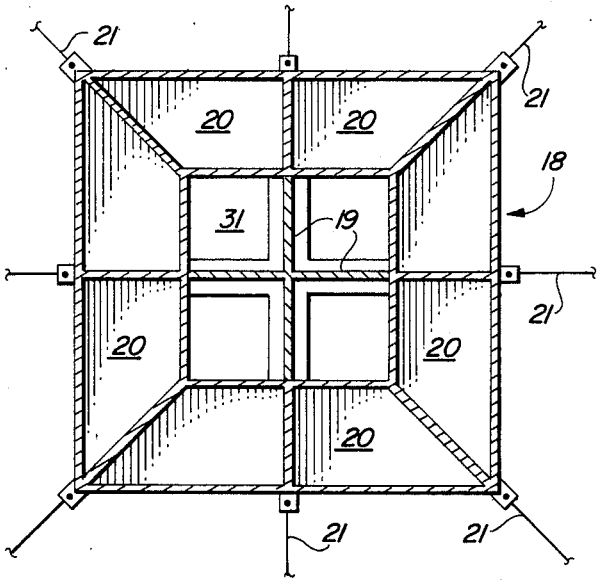
FIG. 3 is a horizontal cross-section view taken along place 3—3 in FIG. 1.
Figure 5:
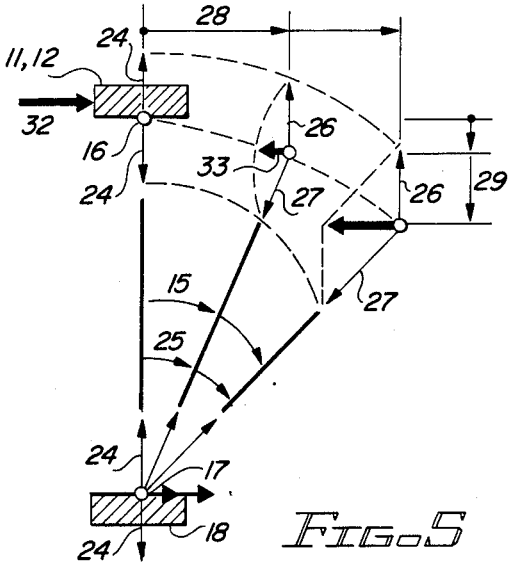
FIG. 5 illustrates the rods 15 action by wave, windstorm and tornado 22 action to the forced deep floating structural body 11,12. The rods 15 are under tension force 24 from the forced deep floating structura body 11,12. The floating structural body 11,12 under wave, windstorm and tornado dynamic and static force horizontal component 22 moves horizontally 28 and INCREASES: (a) the floating depth 29 (b) the slope angle 25 of the rods 15 (c) the vertical component 26 (d) the axial force of the rods 27 and (e) the HORIZONTAL COUNTERFORCE 23 to the dynamic and static force horizontal component 22.

Referring to FIGS. 1, 2 and 3 a floating structural body 11, 12 shown floating in natural deep water 10. The present invention contemplates a new anchoring system in deep water 10 in which the floating structural body 11, 12 is not directly supported or anchored in deep sealed 23 gravity foundation 22. New is the introduction of an INTERMEDIATE FLOATING ELEMENT 18. The intermediate floating element 18 is directly and close to the bottom of the floating structural body 11, 12. The new anchoring system generally consists of two parts.

The FIRST part consists of the intermediate floating element 18, slope cables 21, gravity foundation 22, and seabed 23. The object of the invention is to construct intermediate floating element 18 which remains substantionally in vertical and horizontal position during wave, windstorm and tornado action to the floating structural body 11, 12. There is not direct wave, windstorm and tornado action to the intermediate floating element 18, it can be any convenient shape or material: steel, concrete or other. The weight of the intermediate floating element is less than the weight of the displaced water, therefore there is hydrostatic upward-uplift force. The minimum necessary uplift force is that, which can full the cables 21 tight.

The horizontal and vertical stability of intermediate floating element depends on its own 18 and the deep forced floating structural body's 12, 11 uplift force, anchored by slope cables 21 in gravity foundation 22 placed on the seabed 23. More uplift force, more vertical and horizontal stability. Mor sloping of the cables, more horizontal stability.

19-structural cross beams to horizontal strength.

20-watertight cells.

The SECOND part consists of floating platform 11, hull 12 and rods 15.

The hull 12 is for two reasons: first to raise the uplift force in rods 15. The weight of the hull 12 is less than the displaced water, therefore there is hydrostatic upward-uplift force. Second: for the installation facilities. By gradually pumping the water in and out in the cells 14 There is the necessary depth for the installation of the rods 15. After the hull 12 is installed in its position it will be made permanent with floating platform 11 by bolts, welding or otherwise. The two structures 11 and 12 together form floating structural body.

13-structural cross beams to horizonta strength.

14-watertight cells.

The rods 15 join the floating structural body 11, 12 with the intermediate floating element 18 for compresion and tension forces. The rods 15 through the conventional ball joints 16 and 17 on both ends have complete freedom of rotation, so the relative horizontal and corresponding vertical movement between the floating structural body 11, 12 and intermediate floating element 18 can take place in all directions. The rods are the same length and cannot move axially, therefore the floating structural body 11, 12 can move only parallely to intermediate floting element 18 without swinging.

It is to be understood that the form of my invention herewith shown and described is to be taken as a preferred example of the same and that various changes relative to the material, size, shape and arrangements of parts may be resorted to without departing from the spirit of the invention or the scope of the subjoined.

I claim:

1. A deep water anchoring system for oil drilling platforms and other deep water structures, comprising:

a structural body floating at the surface of a body of water;

an intermediate floating member directly under and spaced from said floating structural body, said intermediate floating member submerged below the surface of said body of water a distance sufficient to be unaffected directly by surface winds and waves;

foundation means at the floor of said body of water;

at least three separate cable means coupled at one end to said foundation means, and at the other other end to said intermediate floating member;

at least three separate and rigid rods; and means for rotatably coupling one end of each of said rods to said intermediate floating member and for rotatably coupling the other end of each of said rods to said floating structural body.

2. The system recited in claim 1 wherein said rotatable coupling means comprises ball bearing joints at each end of each of said rods.

3. The system recited in claim 2 wherein said floating structural body and said intermediate floating member each include plural discrete cells, each of such cells may be flooded or evacuated so as to control the buoyancy characteristics of said floating structural body and said intermediate floating member to thereby control the tension on each said cable means and said rods.

4. The system recited in claim 3 wherein said cells comprise means for controlling the position of said intermediate floating member and the tension of said cable means and said rigid rods, whereby said rods are generally vertical in the absence of significant wave or wind forces on said floating structural body.

5. The system recited in claim 4, wherein said foundation means comprises at least three gravity anchors on the bed of said body of water, said gravity anchors spaced apart from each other a distance substantially greater than the width of said intermediate floating member, whereby each said cable means coupled between said intermediate floating member and each said gravity anchors is at a substantial angle with respect to the vertical direction.

6. A method for anchoring deep water facilities, comprising the steps of:

floating said deep water facility at the surface of a body of water;

submerging an intermediate floating member directly under and spaced from said facility at a depth below the surface of said body of water sufficient to be unaffected directly by surface winds and waves;

anchoring said intermediate floating member to the floor of said body of water; and rotatably coupling said floating deep water facility to said intermediate floating member through at least three separate and rigid rods for transmitting compression and tension forces between said facility and said intermediate floating member.

7. The method recited in claim 6 further comprising the steps of flooding said floating structural body and said intermediate floating member with water to control the buoyancy of both said floating structural body and said intermediate floating member.

8. A deep water anchoring system comprising:

a structural body floating at the surface of the body of water;

an intermediate floating member direct submerge below the surface of said body of water a distance sufficient to be unaffected by surface winds and waves;

gravity anchors on the bed of said body of water;

at least three separate cables, each coupled at one end to one of said gravity anchors and at the other end to said intermediate floating member, said gravity anchors spaced apart from each other along the bed of said body of water a distance substantially greater than the width of said intermediate floating member, whereby said cable are coupled between said intermediate floating member and each of said gravity gravity anchors at a substantial angle with respect to the vertical direction;

at least three separate and rigid rods;

ball bearing joint means for rotatably coupling one end of each of said rods to said intermediate floating member and for rotatably coupling the other end of each of said rods to said floating structural bodies; and means for flooding or evacuating water into and out of said intermediate floating member to thereby control the position of said intermediate floating member and the tension on said rigid rods, whereby said intermediate floating member is positioned directly under said floating structural body and said rods are generally vertical, both in pg,13 the absence of significant wave or wind forces on said floating structural body.

* * * * *